US006432071B1

(12) United States Patent
Hsieh

(10) Patent No.: US 6,432,071 B1
(45) Date of Patent: Aug. 13, 2002

(54) SPHERICAL MASSAGER

(76) Inventor: Wen Sen Hsieh, P.O. Box 2103, Taichung (TW)

( * ) Notice: Subject to any disclaimer, the term of this patent is extended or adjusted under 35 U.S.C. 154(b) by 0 days.

(21) Appl. No.: 09/716,802

(22) Filed: Nov. 20, 2000

(30) Foreign Application Priority Data

Jun. 27, 2000 (TW) ..... 89210981 U

(51) Int. Cl.[7] ..... A61H 1/00

(52) U.S. Cl. ..... 601/72; 601/70; 601/134; 601/131

(58) Field of Search ..... 601/46, 67, 69, 601/70, 72, 78, 80, 131, 134, 135

(56) References Cited

U.S. PATENT DOCUMENTS 3,453,773 A * 7/1969 Compton et al. ..... 46/243
5,297,981 A * 3/1994 Maxim et al. ..... 446/437
5,389,063 A * 2/1995 Wu ..... 601/135
5,413,551 A * 5/1995 Wu ..... 601/46

* cited by examiner

*Primary Examiner*—Michael A. Brown
*Assistant Examiner*—Benjamin K Koo
(74) *Attorney, Agent, or Firm*—Rosenberg, Klein & Lee

(57) ABSTRACT

A Spherical massager composed of two semispherical bodies. Each of the semispherical bodies has a soft facial layer on the surface. The soft facial layer is formed with multiple outward projecting contact sections. The mating faces of the two semispherical bodies are respectively disposed with a power supply section and an oscillation generating section. The power supply section has a recessed female connecting section formed on the connecting face of one of the semispherical bodies. The oscillation generating section including a male connecting section outward projecting from the mating face of the other semispherical body. The male connecting section is formed with a central hole for receiving a vibrating motor. An eccentric wheel is disposed at a front end of a rotary shaft of the vibrating motor to achieve a vibrating effect.

1 Claim, 6 Drawing Sheets

SPHERICAL MASSAGER

BACKGROUND OF THE INVENTION

The present invention relates to a spherical massager having a spherical body in which a vibrating device is disposed to provide a vibrating massaging effect.

There are various kinds of existent massagers which have specific functions. With respect to a computer keying operator, his/her hand is supported at the wrist for keying in papers with the keyboard. After a long period of operation without properly relaxing his/her hand, the muscle of the hand tends to become stiff or tired and the operator will feel uncomfortable. Under a long term of affection, the shoulder of the operator will feel painful. The most widely used electronic pulse-type massager serves to massage and relax the muscle of certain parts of human body. However, such massager fails to expedite blood circulation of a user and cannot provide an effective massaging effect for the hands and thus eliminate the uncomfortable feeling of the user due to insufficient movement.

SUMMARY OF THE INVENTION

It is therefore a primary object of the present invention to provide a spherical massager which is able to directly generate vibration for massaging the hands or other parts of the body of a user.

The present invention can be best understood through the following description and accompanying drawings wherein:

DETAILED DESCRIPTION OF THE PREFERRED EMBODIMENT

Figure 1:
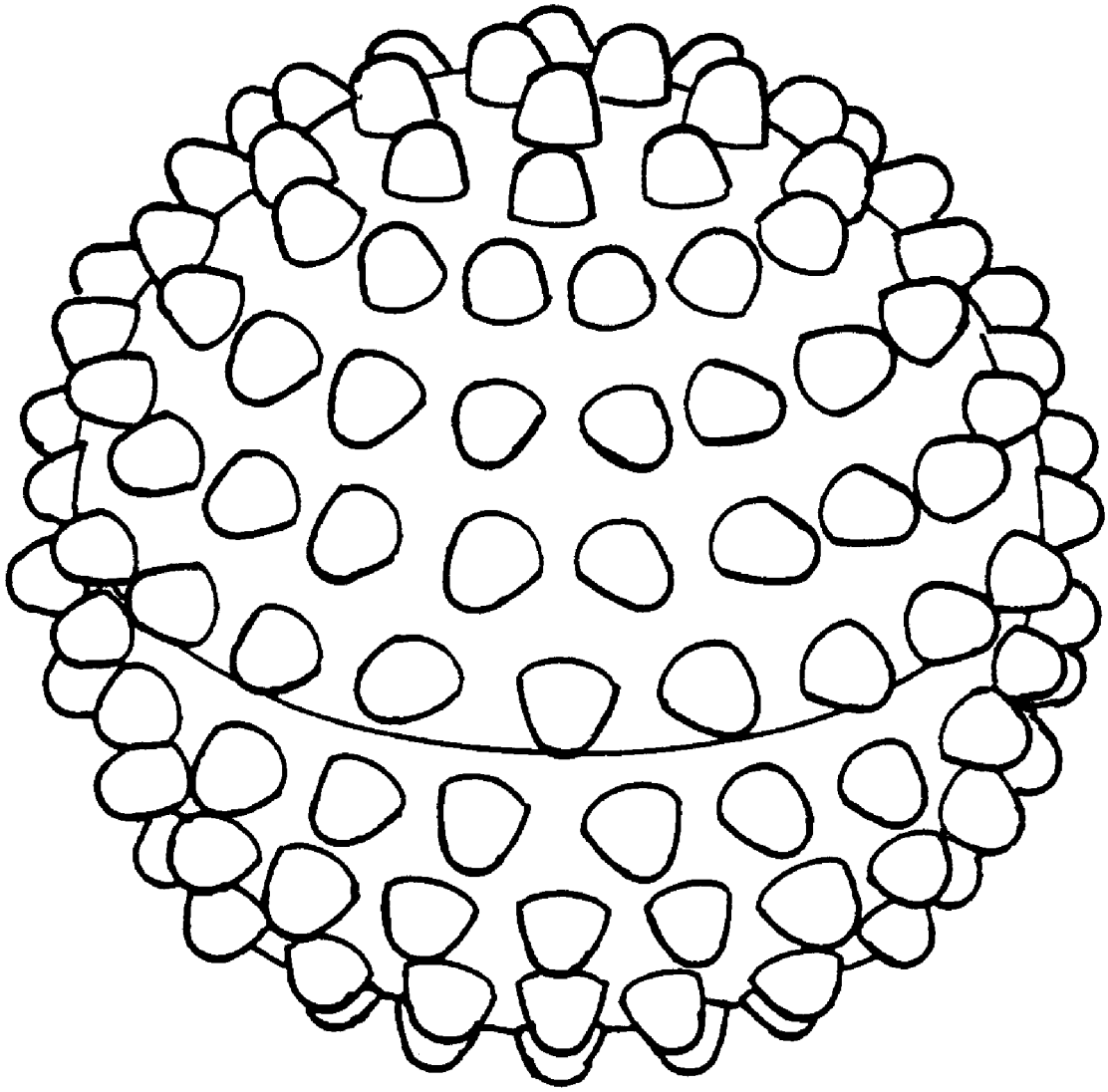
FIG. 1 is a perspective assembled view of the spherical massager of the present invention.
Figure 2:
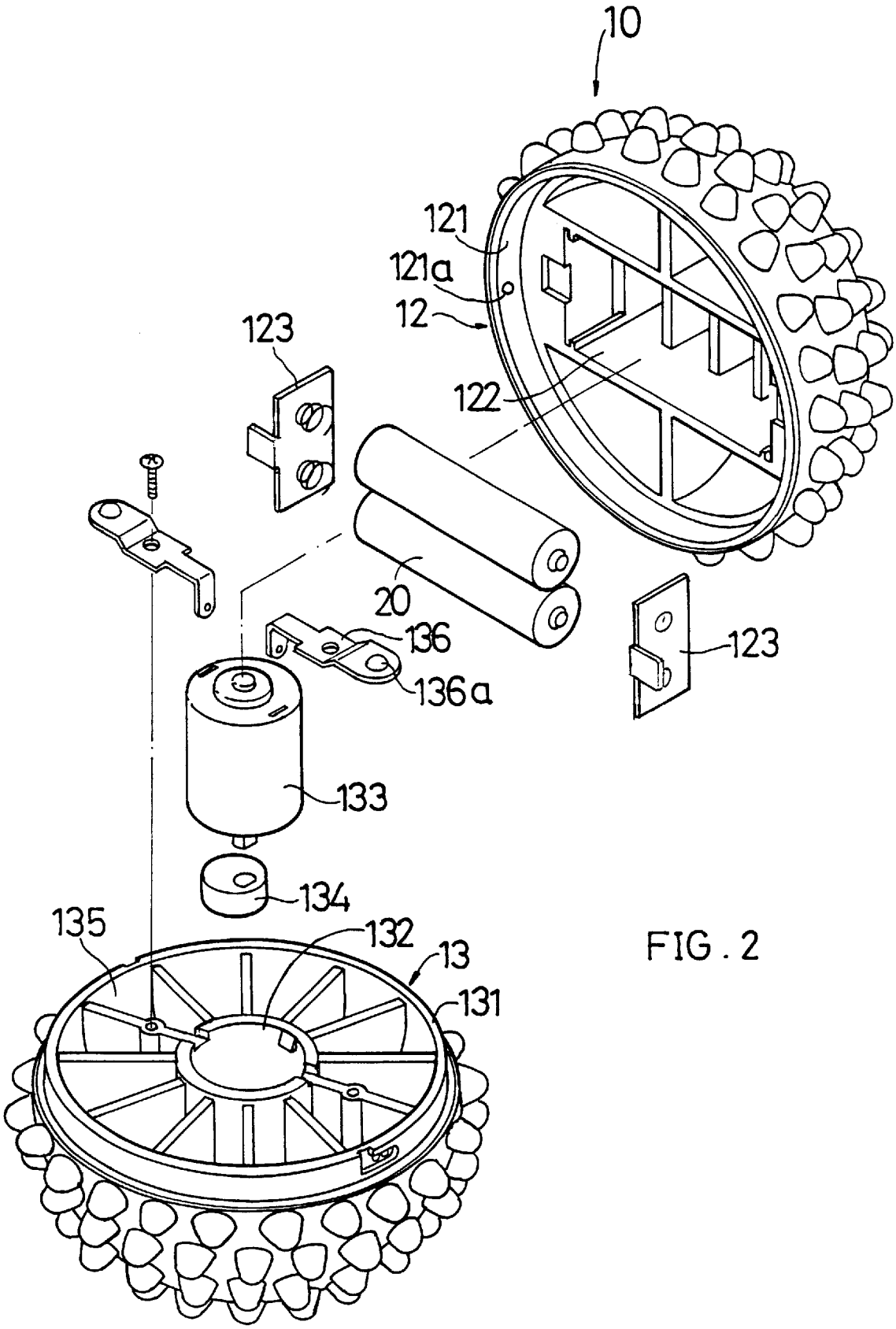
FIG. 2 is a perspective exploded view of the spherical massager of the present invention.
Figure 3:
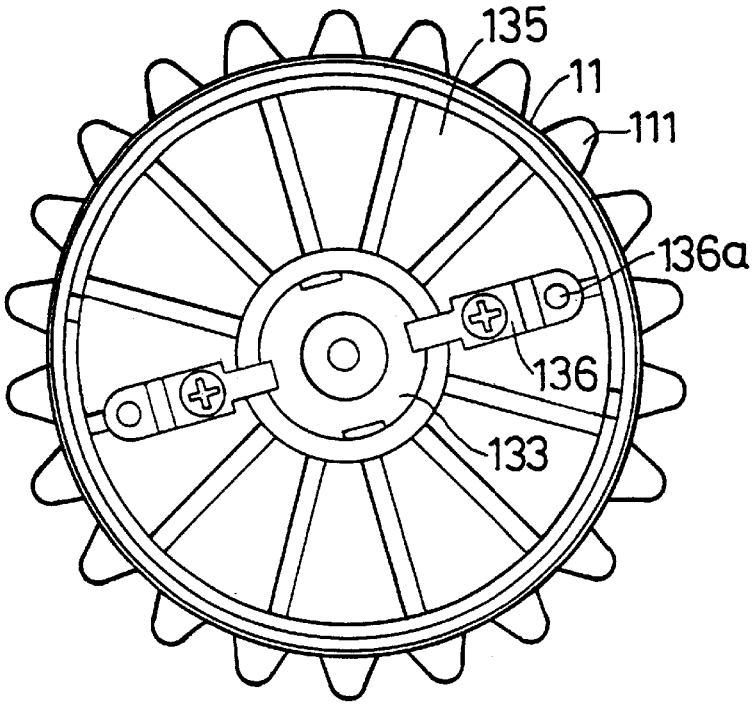
FIG. 3 is a plane view of the oscillation generating section of the spherical massager of the present invention.

Please refer to FIGS. 1 to 3. The spherical massager of the present invention is composed of two semispherical bodies 10. Each semispherical body 10 has a soft facial layer 11 on the surface. The soft facial layer 11 is formed with multiple outward projecting contact sections 111. The mating faces of the two semispherical bodies 10 are respectively disposed with a power supply section 12 and an oscillation generating section 13. The power supply section 12 is characterized by a recessed female connecting section 121 formed on the connecting face of one of the semispherical bodies 10. The female connecting section 121 is formed with an inward extending cavity 122 for receiving cells 20. Two electrode plates 123 are respectively disposed at two ends of the cavity 122.

Figure 5:
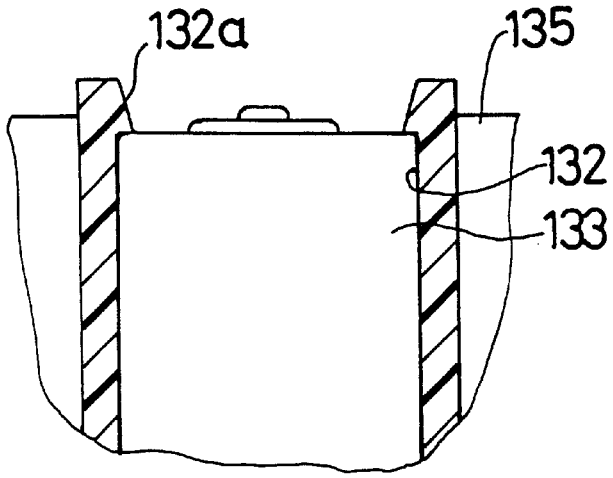
FIG. 5 is an enlarged view showing that the motor is fixed in the central hole of the spherical massager of the present invention.

The oscillation generating section 13 includes a male connecting section 131 outward projecting from the mating face of the other semispherical body 10. The male connecting section 131 is formed with a central hole 132 for receiving a vibrating motor 133. As shown in FIG. 5, the end of the central hole 132 is formed with a flange 132*a* for holding and fixing the vibrating motor 133. In order to achieve a vibrating effect, an eccentric wheel 134 is disposed at the front end of the rotary shaft of the vibrating motor.

Multiple sector-shaped chambers 135 are arranged around the central hole 132. A conductive plate 136 is locked on a side wall of a sector-shaped chamber 135 opposite to each electrode plate 123 of the power supply section 12. One end of the conductive plate 136 is slightly elevated and is formed with a conductive convex section 136*a*. The other end of the conductive plate 136 is connected with the electrode of the vibrating motor.

Figure 6:
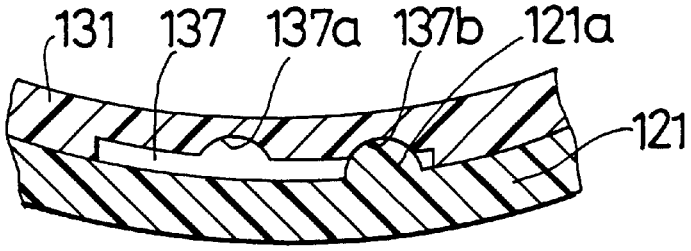
FIG. 6 is a sectional view taken along line VI—VI of FIG. 4.
Figure 7:
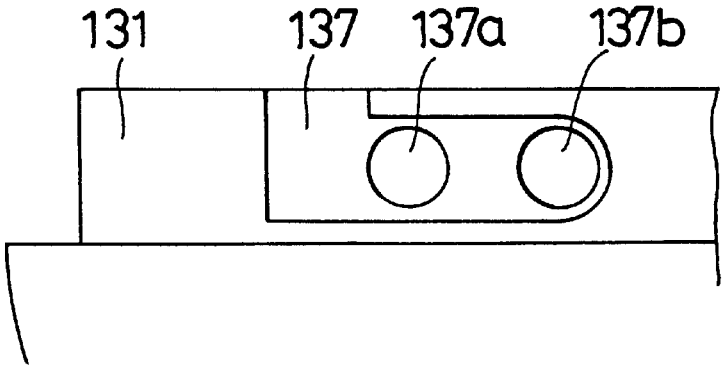
FIG. 7 is an enlarged view showing the L-shaped slots of the male connecting section of the spherical massager of the present invention.

Please refer to FIGS. 6 and 7. The circumference of the male connecting section 131 is formed with two L-shaped slots 137. The bottom of the L-shaped slot 137 is formed with two locating dents 137*a*, 137*b*. The inner circumference of the female connecting section 121 is formed with two tenons 121*a* for locking the two semispherical bodies 10 with each other.

Figure 4:
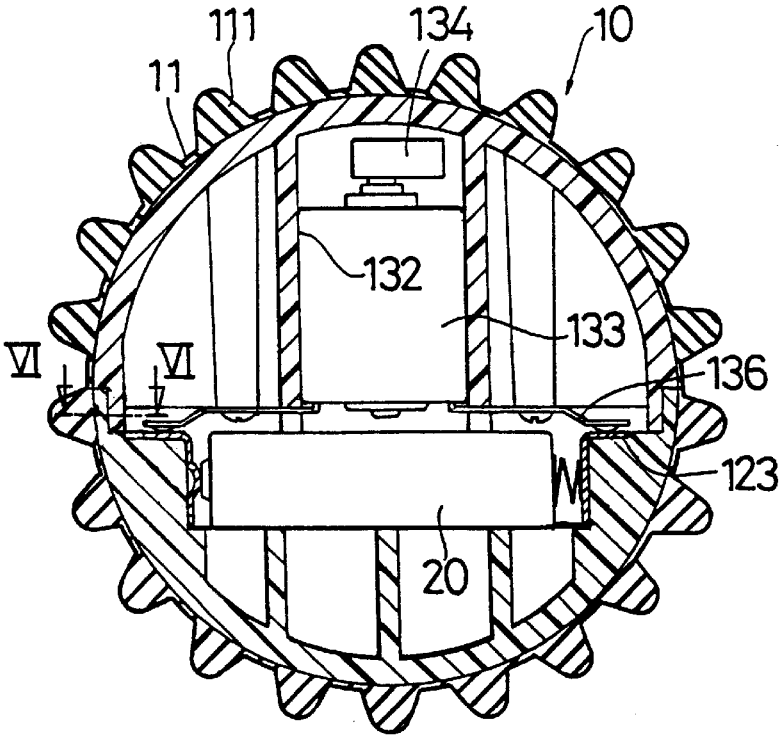
FIG. 4 is a sectional assembled view of the spherical massager of the present invention.
Figure 8:
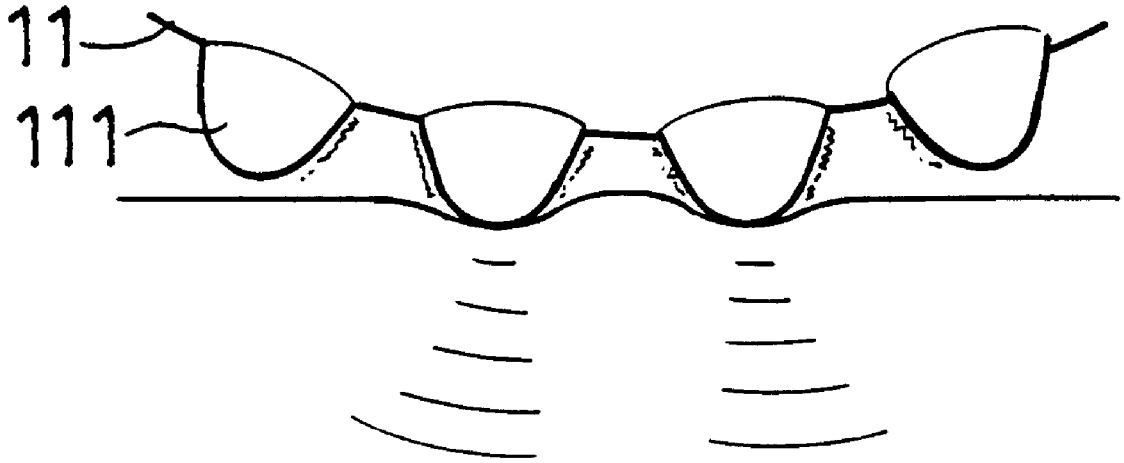
FIG. 8 is a view showing that the outward projecting contact sections of the spherical massager of the present invention are vibrated to provide a massaging effect in one state.
Figure 9:
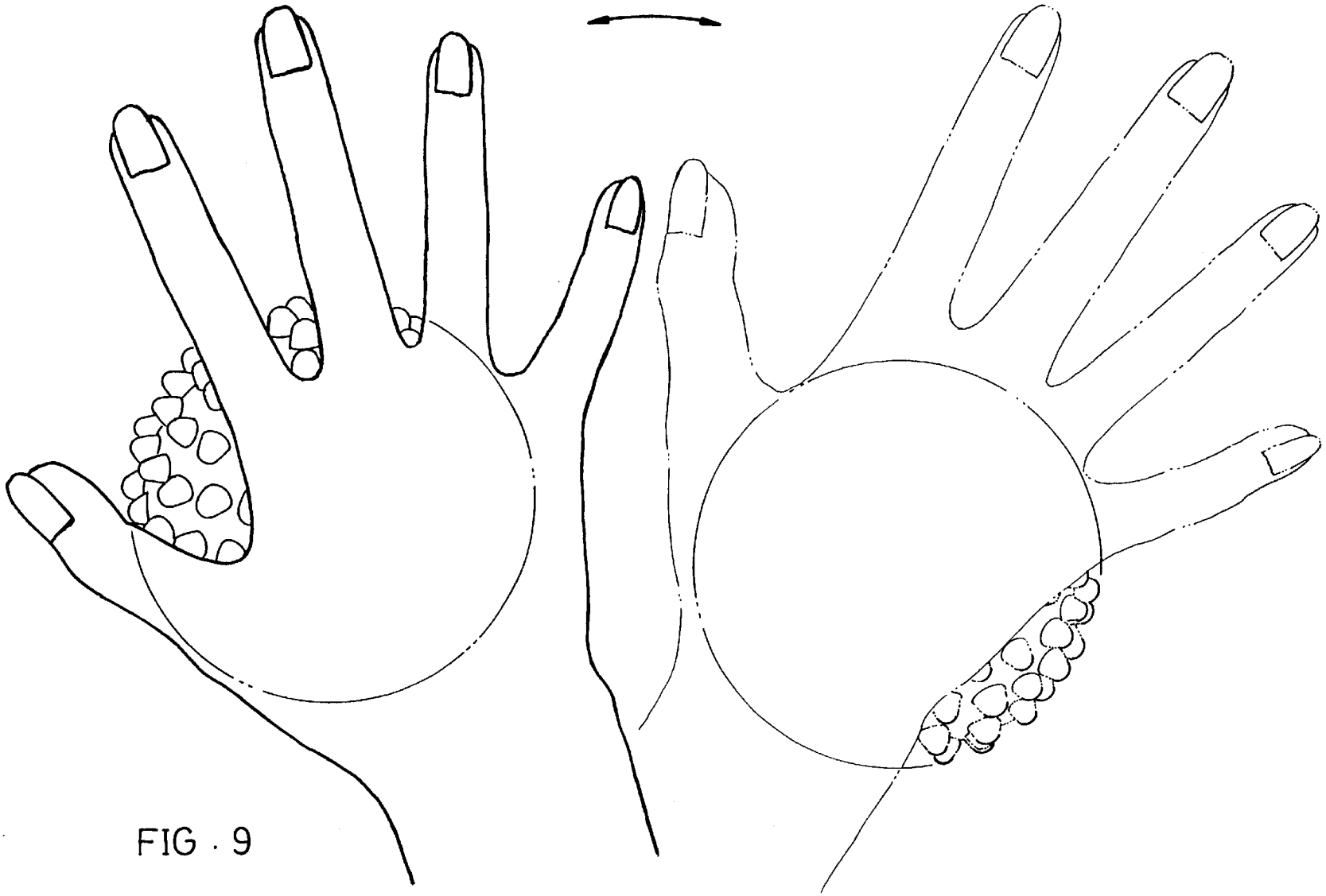
FIG. 9 is a view showing that the outward projecting contact sections of the spherical massager of the present invention are vibrated to provide a massaging effect in another state.

When assembled, the two semispherical bodies 10 are mated with each other and the two tenons 121*a* of the female connecting section 121 are fitted into the two L-shaped slots 137 of the male connecting section 131. Then the two semispherical bodies 10 are rotated to make the tenon 121*a* engaged in an outward locating dent 137*a* of the L-shaped slot 137 so as to fix the two semispherical bodies 10. Then the two semispherical bodies 10 are further rotated to make the tenon 121*a* engaged in the other locating dent 137*b*. At this time, the electrode plates 123 of the power supply section 12 are positioned opposite to the conductive plates 136 of the oscillation generating section 13 (as shown in FIG. 4). At this time, the vibrating motor 133 is powered on and rotated. By means of the eccentric wheel 134 disposed at the front end of the rotary shaft of the vibrating motor, a vibrating effect is achieved when rotated so that the entire spherical massager is vibrated along with the vibrating motor. Accordingly, the outward projecting contact sections 111 of the soft facial layer of the massager contact with a user and massage the user at multiple points as shown in FIGS. 8 and 9. In cooperation with pressing and rolling operation, the hand of the use can be massaged. Alternatively, the use can hold the massager and roll it over his/her entire body without limitation.

The above embodiment is only used to illustrate the present invention, not intended to limit the scope thereof. Many modifications of the above embodiment can be made without departing from the spirit of the present invention.

What is claimed is:

1. A spherical massager comprising:

two semispherical bodies, each of said semispherical bodies having an outer surface with a soft facial layer thereon, said soft facial layer being formed with multiple outward projecting contact sections, a first of said semispherical bodies having a power supply section formed therein and a second of said semispherical bodies having an oscillation generating section formed therein, said power supply section being formed with a female connecting section formed in a connecting face thereof and a recessed cavity for receiving battery cells therein, said female connecting section having a pair of tenons angularly spaced on an inner circumferential surface thereof, said oscillation generating section having a male connecting section projecting outwardly from a mating face thereof, said male connecting section having a pair of L-shaped slots formed in an outer surface thereof in aligned relationship with said tenons, each of said L-shaped slots having a pair of angularly spaced dents in a circumferentially directed portion of said L-shaped slot for selective receipt of a corresponding one of said tenons therein, said two semispherical bodies being locked together by respective engagement of said tenons with at least a first of said dents in a respective L-shaped slot, said second semispherical body having a central hole formed therein;

a pair of electrode plates respectively disposed at opposing ends of said recessed cavity for respective electrical coupling with the battery cells;

a vibrating motor mounted in said central hole of said second semispherical body; and, a pair of conductor plates mounted to said mating face of said oscillation generating section and respectively electrically connected to said vibrating motor, each of said conductor plates having a convex portion formed on a distal end thereof, said convex portion being disposed in respective contact with said pair of electrode plates for energizing said vibrating motor responsive to said tenons being respectively engaged with a second of said dents in said L-shaped slots and said convex portions being respectively separated from contact with said pair of electrode plates when said tenons are respectively engaged with said first of said dents, whereby rotation of one of said semispherical bodies relative to the other to displace said tenons between said first and second dents displaces said pair of conductor plates relative to said pair of electrode plates to switch said vibrating motor on and off.

* * * * *